US006832898B2

(12) United States Patent
Yoshida et al.

(10) Patent No.: US 6,832,898 B2
(45) Date of Patent: Dec. 21, 2004

(54) DRIVING APPARATUS OF A LINEAR COMPRESSOR

(75) Inventors: Makoto Yoshida, Shiga (JP); Sugimatsu Hasegawa, Shiga (JP); Mitsuo Ueda, Hyogo (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 29 days.

(21) Appl. No.: 10/314,351

(22) Filed: Dec. 9, 2002

(65) Prior Publication Data

US 2003/0108430 A1 Jun. 12, 2003

(30) Foreign Application Priority Data

Dec. 10, 2001 (JP) ..... 2001-376434

(51) Int. Cl.[7] ..... F04B 49/06; H02K 41/02

(52) U.S. Cl. ..... 417/44.11; 417/417; 318/119; 318/127; 318/135

(58) Field of Search ..... 417/44.11, 44.1, 417/45, 415, 417; 318/135, 124, 119, 127

(56) References Cited

U.S. PATENT DOCUMENTS 5,272,429 A * 12/1993 Lipo et al. ..... 318/808
5,883,489 A * 3/1999 Konrad ..... 318/807
5,945,802 A * 8/1999 Konrad et al. ..... 318/807
6,181,583 B1 * 1/2001 Okui et al. ..... 363/45
6,254,353 B1 * 7/2001 Polo et al. ..... 417/44.11
6,501,240 B2 * 12/2002 Ueda et al. ..... 318/135

* cited by examiner

*Primary Examiner*—Michael Koczo
(74) *Attorney, Agent, or Firm*—Armstrong, Kratz, Quintos, Hanson & Brooks, LLP.

(57) ABSTRACT

In a driving apparatus of a linear compressor 1 having a power source capable of controlling output current and measuring output electric power, frequency of the linear compressor 1 is controlled such that the amplitude of current which is supplied to the linear compressor 1 is made constant and electric power which is supplied to the linear compressor 1 becomes maximum. With this, it is possible to drive the linear compressor 1 efficiently while following the resonance frequency which keeps varying with variation of a load. Further, a current detecting means 8 capable of detecting output current and electric power from inverter input current is provided, and it is unnecessary to newly add a current sensor.

4 Claims, 12 Drawing Sheets

DRIVING APPARATUS OF A LINEAR COMPRESSOR

FIELD OF THE INVENTION

The present invention relates to a driving apparatus of a linear compressor for reciprocating a piston in a cylinder by a linear motor to generate compressed gas in a compression chamber formed by the cylinder and the piston.

BACKGROUND OF THE INVENTION

Conventionally, a linear compressor utilizing elasticity of a mechanical elastic member or compressed gas is known as means for generating compressed gas.

To efficiently drive the linear compressor, it is necessary to drive the linear compressor at resonance frequency of the linear compressor. In a linear compressor having the elastic member, the resonance frequency of the linear compressor is determined by the elastic member (mechanical spring) which is mechanically provided and elasticity (gas spring) generated by compressed gas. In a linear compressor utilizing only elasticity of compressed gas, the resonance frequency is determined only by the elasticity. However, since the elasticity generated by the compressed gas is largely varied with variation of load, the resonance frequency of the linear compressor can not be determined as one value. Therefore, the conventional technique employs a method for calculating the varying resonance frequency utilizing a phenomenon that a resonance state is established when phases of input current and piston speed are equal to each (Japanese Patent Application Laid-open No. H10-26083).

This conventional method will be explained briefly with reference to a flowchart shown in FIG. 13.

When detection control of resonance frequency is started, in step S20, a sine wave current command value Iref which is input from driving frequency f to the linear compressor is formed. In step S21, current piston speed Vnow is obtained by position information of the piston from a position sensor provided in the linear compressor. In step S22, a position difference between the Iref and Vnow obtained in the above steps, and if the Iref advanced, the procedure is proceeded to step S23, and if the phases are equal to each other, the procedure is proceeded to step S24, and if the Iref delayed, the procedure is proceeded to step S25. In step S23, since the current driving frequency is lower than the resonance frequency and thus, the driving frequency f is increased and the procedure is returned to step S20. In step S24, since the current driving frequency is equal to the resonance frequency, the driving frequency f is not changed and the procedure is returned to step S20. In step S25, since the current driving frequency is higher than the resonance frequency and thus, the driving frequency f is reduced and the procedure is returned to step S20. In this manner, the driving frequency is controlled such that it becomes equal to the resonance frequency using the position information of the piston obtained by the position sensor.

However, in order to employ this method, it is necessary to measure the displacement of the piston in the cylinder. Therefore, a displacement measuring apparatus must be incorporated in the linear compressor. Therefore, there are caused not only a problem that a volume of the linear compressor is increased by a volume of the displacement measuring apparatus, but also a problem that the operational reliability of the displacement measuring apparatus must be secured under rigorous operation conditions such as a temperature, a pressure and refrigerant resistance because the displacement measuring apparatus itself must be enclosed in a shell of the linear compressor.

Further, since it is necessary to differentiate a signal from a displacement sensor and to calculate the position difference between speed and current, a relatively complicated control apparatus such as microcomputer, MPU (micro processor unit) or the like is required.

In view of the above problems, it is an object of the present invention to calculate resonance frequency relatively easily without displacement of a piston in a linear compressor, and to drive the linear compressor efficiently using an inexpensive circuit.

SUMMERY OF THE INVENTION

A first aspect of the present invention provides a driving apparatus of a linear compressor for driving a piston in a cylinder by a linear motor to generate compressed gas, comprising an inverter for outputting alternating current which is supplied to the linear motor, a direct current power source for supplying direct current voltage to the inverter, current value commanding means for determining and commanding magnitude of the alternating current, electric power detecting means for detecting input electric power which is supplied to the linear compressor, driving frequency determining means for varying driving frequency of the inverter such that the electric power detected by the electric power detecting means becomes maximum, current waveform commanding means for generating command current waveform from a command current value from the current value commanding means and from a driving frequency determined by the driving frequency determining means, and inverter control means for sending a control signal to the inverter based on the command current waveform from the current waveform commanding means.

According to this aspect, the frequency is varied so that the input electric power which is supplied to the linear motor becomes maximum. That is, to control the effective electric power such that it becomes maximum based on a condition that alternating output current is constant is to control such that a phase of the output current becomes equal to a phase of speed (induction voltage). According to this mode, it is possible to control the linear compressor to resonance frequency without detecting the displacement of the piston.

According to a second aspect of the invention, in the driving apparatus of the linear compressor of the first aspect, the driving apparatus further comprises current detecting means for detecting input current which is supplied to the inverter or output current which is output from said inverter, and voltage detecting means for detecting input voltage of the inverter, and the electric power detecting means calculates input electric power which is supplied to the linear compressor from current detected by the current detecting means and voltage detected by the voltage detecting means, the inverter control means sends a control signal to the inverter such that a deviation between a command current value from the current value commanding means and a detection current value from the current detecting means is reduced.

According to this aspect, direct current and input voltage which are input and output to the inverter are detected, and with a relatively simple calculation in which they are multiplied, it is possible to approximately detect the input electric power which is supplied to the linear motor. The output current value is controlled substantially constantly such that the output current value becomes the command value. That is, to control the effective electric power such that it becomes maximum based on a condition that alternating output current is constant is to control such that a phase of the output current becomes equal to a phase of speed (induction voltage). According to this mode, it is possible to control the linear compressor to resonance frequency without detecting the displacement of the piston.

According to a third aspect of the invention, in the driving apparatus of the linear compressor of the first aspect, the driving apparatus further comprises current detecting means for detecting a smoothened value of sawtooth-like inverter input current as input current or detecting a peak value as output current, and voltage detecting means for detecting input voltage of the inverter, and the electric power detecting means calculates input electric power which is supplied to the linear compressor from current detected by the current detecting means and voltage detected by the voltage detecting means, the inverter control means sends a control signal to the inverter such that a deviation between a command current value from the current value commanding means and a detection current value from the current detecting means is reduced.

According to this aspect, it is possible to detect input current which is supplied to and output current which is output from the inverter by detecting current in only one location using a shunt resistor and a current sensor which are previously provided as a protecting circuit. It is possible to approximately detect the input electric power which is supplied to the linear motor with a relatively simple calculation in which the smoothened value of input current which is supplied to the inverter and the direct current voltage are multiplied. A peak value of the input current corresponding to the output current is substantially constantly controlled such that the peak value becomes the command value and in this state, the frequency is varied such that the electric power becomes maximum. That is, to control the effective electric power such that it becomes maximum based on a condition that the peak value of the input current corresponding to the alternating output current is constant is to control such that a phase of the current becomes equal to a phase of speed (induction voltage). According to this mode, it is possible to control the linear compressor to resonance frequency without detecting the displacement of the piston.

According to a fourth aspect of the invention, in the driving apparatus of the linear compressor of the first aspect, the driving apparatus further comprises current detecting means for detecting input current which is supplied to the direct current power source or output current which is output from the inverter, and voltage detecting means for detecting input voltage which is supplied to the direct current power source, and the electric power detecting means calculates input electric power which is supplied to the linear compressor from current detected by the current detecting means and voltage detected by the voltage detecting means, the inverter control means sends a control signal to the inverter such that a deviation between a command current value from the current value commanding means and a detection current value from the current detecting means is reduced.

According to this aspect, current and voltage of a commercial power source which are input to the direct current power source are detected, and with a relatively simple calculation in which they are multiplied, it is possible to approximately detect the input electric power which is supplied to the linear motor. The output current is substantially constantly controlled such that the output current becomes the command value and in this state, the frequency is varied such that the electric power becomes maximum. That is, to control the electric power such that it becomes maximum based on a condition that alternating output current is constant is to control such that a phase of the current becomes equal to a phase of speed (induction voltage). According to this mode, it is possible to control the linear compressor to resonance frequency without detecting the displacement of the piston.

According to a fifth aspect of the invention, in the driving apparatus of the linear compressor of the first aspect, the driving apparatus further comprises first current detecting means for detecting input current which is supplied to the direct current power source, and second current detecting means for detecting output current which is output from the inverter, and the electric power detecting means calculates input electric power which is supplied to the linear compressor from current detected by the first current detecting means and the direct current power source voltage, the inverter control means sends a control signal to the inverter such that a deviation between a command current value from the current value commanding means and a detection current value from the second current detecting means is reduced.

According to this aspect, the input electric power which is supplied to the linear motor is approximately detected from the current which is input to the direct current power source. That is, the input voltage which is supplied to the direct current power source is stable when the input which is supplied to the direct current power source is a commercial power source. Therefore, the electric power is substantially proportional to the input current, and it is possible to detect the electric power in the easiest manner. The output current is substantially constantly controlled such that the output current becomes the command value and in this state, the frequency is varied such that the electric power becomes maximum. That is, to control the electric power such that it becomes maximum based on a condition that alternating output current is constant is to control such that a phase of the output current becomes equal to a phase of speed (induction voltage). According to this mode, it is possible to control the linear compressor to resonance frequency without detecting the displacement of the piston.

According to a sixth aspect of the invention, in the driving apparatus of the linear compressor of the fifth aspect, the second current detecting means detects a peak value of sawtooth-like inverter input current as inverter output current.

According to this aspect, it is possible to detect alternating output current using a shunt resistor and a current sensor which are previously provided as a protecting circuit. A peak value of the input current corresponding to the output current is substantially constantly controlled such that the peak value becomes the command value and in this state, the frequency is varied such that the electric power becomes maximum. That is, to control the electric power such that it becomes maximum based on a condition that the peak value of the input current corresponding to the alternating output current is constant is to control such that a phase of the current becomes equal to a phase of speed (induction voltage). According to this mode, it is possible to control the linear compressor to resonance frequency without detecting the displacement of the piston.

DETAILED DESCRIPTION OF THE PREFERRED EMBODIMENT

Embodiments of the present invention will be explained below based on the drawings.

Figure 1:
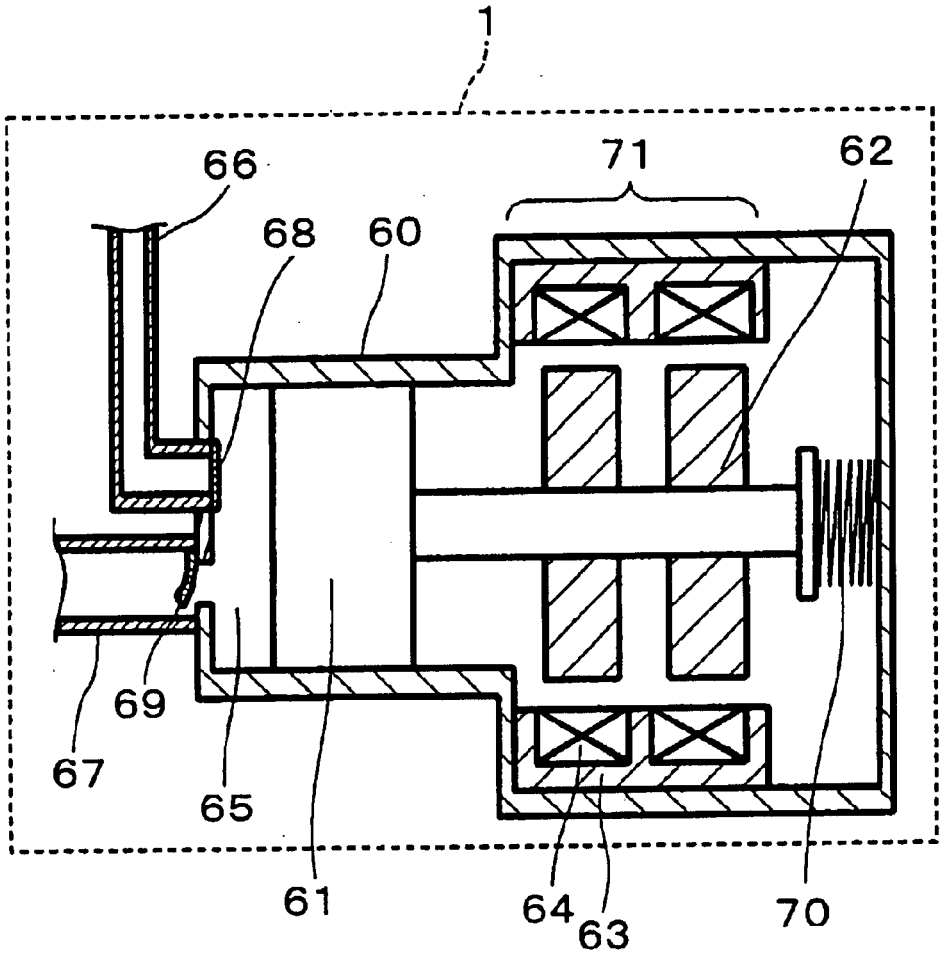
FIG. 1 is a schematic diagram showing an outline structure of a linear compressor.

A structure of a linear compressor using a spring as an elastic member will be explained using FIG. 1. A piston 61 is slidably supported in a cylinder 60 along an axial direction of the piston 61. Magnets 62 are fixed to the piston 61. Stator coils 64 are embedded in an outer yoke 63 at position opposed to the magnets 62. The cylinder 60 and the piston 61 form a compression chamber 65. A suction pipe 66 and a discharge pipe 67 are connected to each other in the compression chamber 65. The suction pipe 66 has a suction valve 68, and the discharge pipe 67 has a discharge valve 69. The piston 61 is elastically supported by a resonance spring 70. In FIG. 1, a linear motor 71 comprises the outer yoke 63, the stator coils 64 and the magnets 62. If the linear motor 71 is intermittently energized through a motor driver (not shown), the piston 61 reciprocates in its axial direction, and refrigerant is drawn and compressed in the compression chamber 65.

Figure 2:
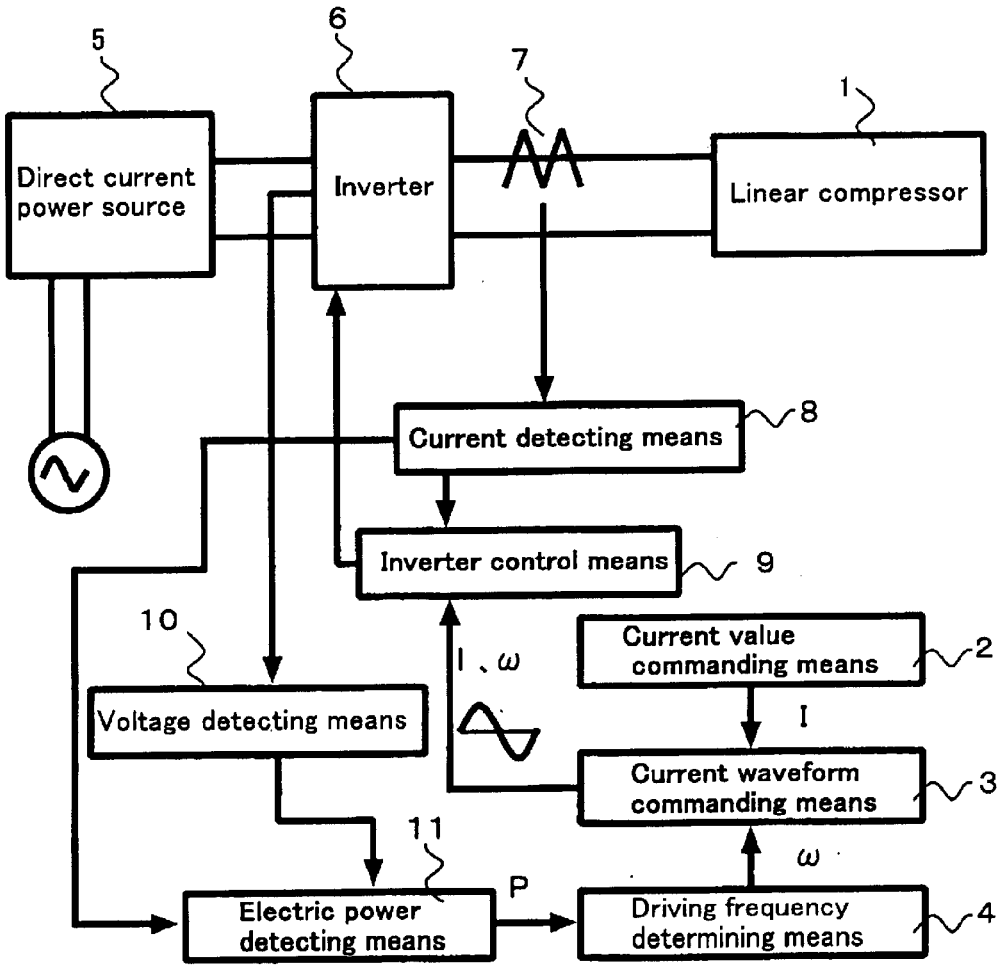
FIG. 2 is a block diagram showing a structure of a driving apparatus of the linear compressor according to an embodiment of the present invention.

FIG. 2 is a block diagram showing a structure of a driving apparatus of the linear compressor 1 according to the embodiment of the invention.

In FIG. 2, the driving apparatus comprises a direct current power source 5, a current detecting means 8, a voltage detecting means 10, an electric power detecting means 11, an inverter control means 9, an inverter 6, a current value commanding means 2, a driving frequency determining means 4 and a current waveform commanding means 3. The direct current power source 5 supplies direct current voltage to the inverter 6. Generally, the direct current power source 5 comprises a diode bridge or a smoothing capacitor which rectifies alternating current of a commercial alternating current power source. The current detecting means 8 detects current which is supplied to the linear motor which drives the linear compressor 1, from a current sensor 7.

The voltage detecting means 10 detects voltage which is supplied, from the inverter 6, to the linear motor which drives the linear compressor 1. However, it is difficult to directly measure the output of the inverter 6 because the output is of PWM waveform. Therefore, using a low-pass filter formed of a transformer, a capacitor and a resistor, the PWM waveform is reshaped and measured. The electric power detecting means 11 calculates output electric power P (which is the same as input electric power P of the linear compressor) of the inverter 6 from output current and output voltage of the inverter 6. As a detecting method of the electric power in this case, instantaneous electric power is calculated from a product of the measured instantaneous voltage and instantaneous current, it is added for one period of the driving frequency or for the duration corresponding to an integral multiple of the period, thereby calculating the output electric power of the inverter. It is possible to realize the same thing also by allowing the instantaneous electric power to pass through the low-pass filter. More specifically, the instantaneous electric power calculated last time is multiplied by a certain weight (e.g., 0.9999), a weight which makes 1 if it is added to the former weight (i.e., 0.0001) is multiplied by the instantaneous electric power which was calculated this time, and they are added. Alternatively, it is also possible to realize the same thing by detecting effective values of output current and output voltage, and their position difference (power factor), and multiplying them.

The inverter control means 9 controls output PWM width of the inverter 6 such that a deviation between a command current value and detection current is reduced. In this inverter control means 9, a deviation between the command current value and the detection current is subjected to PI (proportional-plus-integral) control having appropriate gain, and output PWM width of the inverter 6 is determined. The inverter 6 is driven with the PWM width determined by the inverter control means 9. The inverter 6 used here may be a single-phase full bridge inverter or a single-phase half bridge inverter. The current value commanding means 2 determines the amplitude value I of current which is input to the linear motor from a state of the linear compressor 1 or a system state in which the linear compressor 1 is incorporated. The driving frequency determining means 4 adjusts and determines the frequency such that the input electric power P (which is the same as the output electric power of the inverter) which is supplied to the linear motor measured by the electric power detecting means 11 becomes maximum in a state in which the amplitude of current which is input to the linear motor is constant. The current waveform commanding means 3 forms the determined amplitude value I and current waveform of frequency, and commands the inverter control means 9 to output the same waveform.

Figure 3:
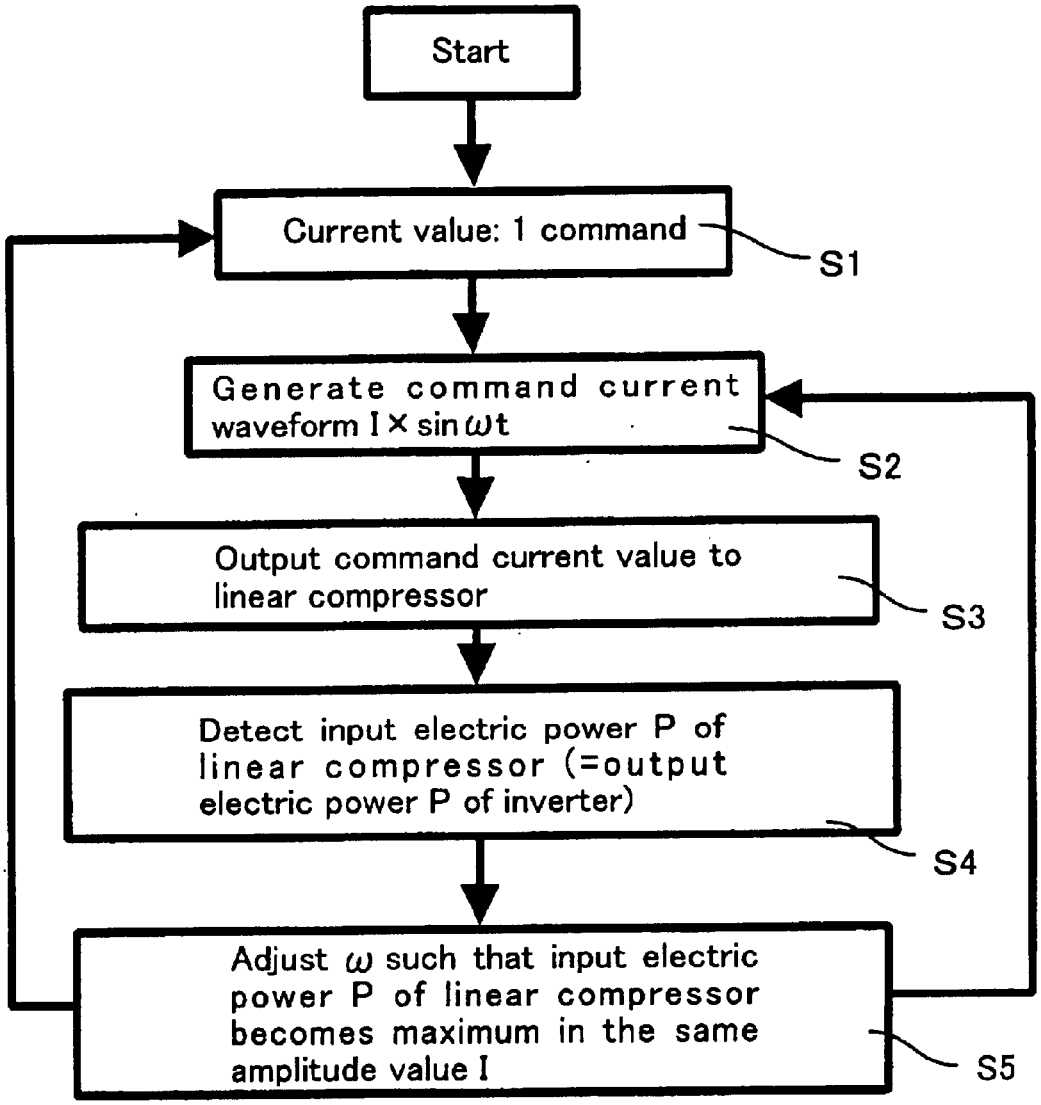
FIG. 3 is a flowchart showing a control operation of the embodiment.

FIG. 3 is a flowchart showing the control operation of this embodiment. In accordance with this flowchart, the operation of the linear compressor 1 and its driving apparatus shown in FIG. 2 will be explained briefly.

When the linear compressor 1 is activated and the linear compressor 1 is stabilized in its steady state and the activation of the control method of the present invention is instructed, the amplitude value I of current which is input to the linear motor is determined by the current value commanding means 2 in step S1 in a state of the linear compressor 1 or a system state in which the linear compressor 1 is incorporated. In step S2, the current waveform commanding means 3 generates command current waveform $I \times \sin \omega t$ from the I determined by the current value commanding means 2 and the $\omega$ determined from the driving frequency determining means 4. In step S3, the inverter control means 9 and the inverter 6 supply current to the linear compressor 1, based on the command current waveform I×sin ωt. In step S4, the electric power detecting means 11 measures the electric power P which is supplied to the linear compressor 1. In step S5, the driving frequency ω is adjusted such that the supply electric power P becomes maximum under a condition that the current amplitude I supplied to the linear compressor 1 by the driving frequency determining means 4 is constant. Steps S2 to S5 are repeated until the supply electric power P becomes maximum. If the supply electric power P becomes maximum, the procedure is returned to step S1.

As an example of the driving frequency determining means 4, a method having two variables, driving frequency changing period, driving frequency changing amount, one flag, and driving frequency changing direction flag will be explained concretely using a flowchart shown in FIG. 4. The driving frequency changing period is control period when the driving frequency determining means 4 is operated. The driving frequency changing amount is a driving frequency changing amount changed by the driving frequency determining means 4 in one action. The driving frequency changing direction flag shows a changing direction of driving frequency determined by the driving frequency determining means 4 last time, and changing direction of this time. When the flag shows 1, this means increase of frequency. When the flag shows −1, this means reduction of frequency.

If the driving frequency determining means 4 is called up, electric power which is input to the linear compressor 1 obtained when the driving frequency determining means 4 was called up last time in step S10 is compared with electric power which is obtained this time. More specifically, a difference of electric power is calculated by subtracting the electric power of this time from the electric power of last time. If this electric power difference is negative value, this means that the driving frequency determined last time in step S11 was changed in a direction in which the resonance frequency of the linear compressor 1 is removed and therefore, the driving frequency changing direction flag is inverted in a positive/negative manner. If the electric power difference is positive value or zero, this means that the driving frequency determined last time in step S12 was changed in a direction to follow the resonance frequency of the linear compressor 1 and therefore, the driving frequency changing direction flag is held as it is. If the driving frequency changing direction flag is a positive value, the driving frequency of this time is increased by the driving frequency changing amount and determined in step S13. On the other hand, if the driving frequency changing direction flag is a negative value, the driving frequency of this time is decreased by the driving frequency changing amount and determined in step S14. Then, the procedure is brought into a standby state for a driving frequency changing period and is returned to step S10.

By using this method, the driving frequency determining means 4 changes the driving frequency by driving frequency changing amount each for the driving frequency changing period, and changes the driving frequency so that the electric power which is input to the linear compressor 1 becomes maximum.

This method has an adverse possibility that when a load of the linear compressor is unstable, electric power which is input to the linear compressor is changed even if the driving frequency is not changed and thus, the driving frequency determined by the driving frequency determining means 4 is determined in a direction in which the driving frequency is out from the maximum electric power driving frequency of the linear compressor 1. Thereupon, it is also possible to set such that if the driving frequency determining means 4 determines the same driving frequency at least twice or more and the electric power is changed more than a given value, the driving frequency which was determined last time is held so that the driving frequency is not changed until a load is stabilized. With this method, the driving frequency determining means 4 does not determine the driving frequency in the direction in which the driving frequency is out from the maximum electric power driving frequency even when the load is unstable, and the linear compressor can be operated stably. Here, the changing of the electric power more than the given value used for judgment may be a certain value or a certain rate to the entire value.

When the changing amount of the electric power is great, it should be conceived that the driving frequency is largely deviated from the maximum electric power driving frequency and thus, the driving frequency changing period is shortened, and when the changing amount of the electric power is small, it should be conceived that the linear compressor is driven in the vicinity of the maximum electric power driving frequency and thus, the driving frequency changing period is elongated. With this, it is possible to follow the stable and high speed maximum electric power driving frequency.

Figure 4:
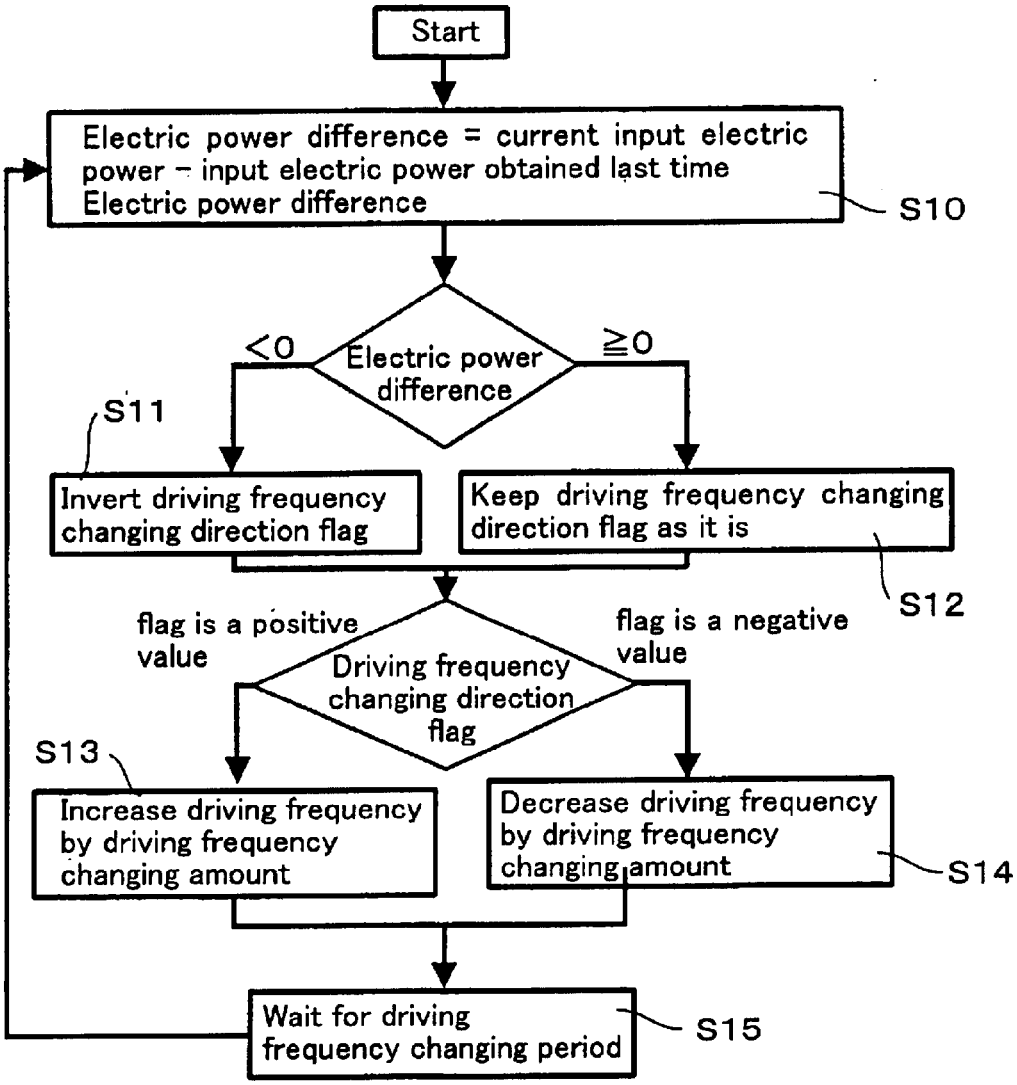
FIG. 4 is a flowchart showing an example of operation of driving frequency determining means.

According to the method shown in FIG. 4, the driving frequency determining means 4 always changes the driving frequency and monitors the driving frequency which becomes maximum electric power. Therefore, the driving frequency is vertically changed with cycles of driving frequency changing period by the driving frequency changing amount around the driving frequency which becomes maximum electric power. Therefore, a portion of the driving operation out from the driving frequency which can obtain the maximum electric power can not be ignored. Thereupon, when the changing amount of the electric power is great, it should be conceived that the driving frequency is largely out from the maximum electric power driving frequency and thus, the driving frequency changing amount is increased, and when the changing amount of the electric power is small, it should be conceived that the linear compressor is driven in the vicinity of the maximum electric power driving frequency and thus, the driving frequency changing amount is reduced. With this, it is possible to follow the stable and high speed maximum electric power driving frequency.

To control the ability of the linear compressor 1, it is absolutely necessary to change the command current value, but since the operation of the driving frequency determining means 4 when the current amplitude value is not constant is not insured, there is an adverse possibility that the driving frequency is determined to be a value which is largely out from the resonance frequency of the linear compressor 1 when the command current value is changed. Thereupon, when the command current value is being changed, if the operation of the driving frequency determining means 4 is stopped, stable operation can be expected even if the current amplitude value is changed. When the command current value is changed, if the driving frequency determined by the driving frequency determining means 4 does not yet reach the maximum electric power driving frequency of the linear compressor 1, there is an adverse possibility that the current amplitude value is changed more than necessary so as to obtain required ability. Thereupon, if the changing amount of the electric power is great more than a given value in the driving frequency determining means 4, it should be conceived that the driving frequency does not yet reach the maximum electric power driving frequency of the linear compressor 1 and thus, the change of the current amplitude value is suppressed. With this method, the current amplitude value is not increased more than necessary, and it is possible to expect that the linear compressor 1 is driven stably.

Figure 5:
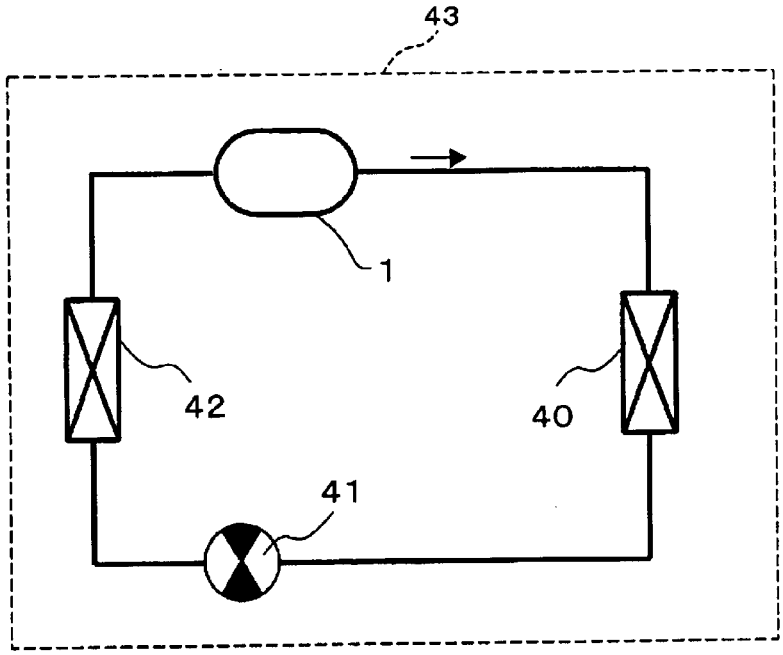
FIG. 5 is a diagram showing a system structure of the embodiment which is incorporated in a refrigeration cycle apparatus.

When the linear compressor 1 is used as at least a portion of a refrigeration cycle apparatus 43 having a condenser 40, a throttling apparatus 41 and an evaporator 42, as shown in FIG. 5, the current value commanding means 2 determines a current amplitude value which is input to the linear compressor 1 from an ambient temperature of at least one portion of the refrigeration cycle apparatus 43 and a set temperature corresponding to the ambient temperature. More specifically, the command current value is determined using proportional-plus-integral control or the like so as to reduce a difference between the ambient temperature and the set temperature. There is also a method in which the command current value is determined with reference to table values which are previously formed from the temperature difference. With this method, the refrigeration cycle apparatus 43 can control the ability of the linear compressor 1 such that the temperature is controlled to a value desired by a user. It is also possible to employ a method in which electric power which is to be input to the linear compressor 1 is calculated from a temperature difference between the ambient temperature and the set temperature, and the command current value is determined such that such electric power is obtained.

When the linear compressor 1 is actuated, since gas filled in the linear compressor 1 is not stable, if the command current value is abruptly increased, there is a danger that a tip end of the piston collides against a head of the cylinder. Thus, when the current value commanding means 2 is actuated, the current amplitude value is gradually increased.

On the other hand, when the linear compressor 1 is stopped, since there is a difference between suction pressure and discharge pressure, if the current amplitude value is abruptly reduced, there is a danger that the tip end of the piston collides against the head of the cylinder or a spring used for resonance is plastically deformed. Thus, when the current value commanding means 2 is stopped, the current amplitude value is gradually reduced.

Next, the operation of the present embodiment will be explained using equations.

A relation of input/output energy of the linear motor which drives the linear compressor can be expressed as the following (equation 1).

$$P_i = P_o + \tfrac{1}{2} \times R \times I^2 \qquad \text{(equation 1)}$$

In the (equation 1), $P_o$ represents average output energy of the linear motor, $P_i$ represents average input energy of the linear motor, R represents equivalent resistor existing in the linear motor, and I represents amplitude of sine wave current which is input to the linear motor.

As can be found from this equation, a loss in the linear motor is equal to Joule heat caused by the equivalent resistor existing in the linear motor. If the equivalent resistor is invariable, this loss is determined only by the current amplitude value irrespective of value of frequency of current.

A relation of ratio (compressor mechanical efficiency, hereinafter) of output of the linear compressor to input of the linear compressor (linear motor output) is expressed as the following (equation 2).

$$P_c = \varsigma_m \times P_o \qquad \text{(equation 2)}$$

In (equation 2), $P_c$ represents output of the linear compressor output, and ç represents the mechanical efficiency of the compressor.

From these, a ratio (total efficiency, hereinafter) of output of the linear compressor and input of the linear motor is expressed as the following (equation 3).

$$\begin{aligned} \varsigma &= P_c / P_i \qquad \text{(equation 3)} \\ &= (\varsigma_m \times P_o)/(P_o + 1/2 \times R \times I^2) \\ &= \varsigma_m / (1 + (1/2 \times R \times I^2)/P_o) \end{aligned}$$

In the (equation 3), ç is the total efficiency. The compressor mechanical efficiency $\varsigma_m$ is constant in the vicinity of a certain operation state of the linear compressor. Therefore, it can be found from the (equation 3) that when the linear compressor is driven while constantly keeping the amplitude I of current which is input to the linear motor, the linear motor output $P_o$ should be controlled such that it becomes maximum to maximize the total efficiency ç. Further, since the linear motor is driven while constantly keeping the amplitude I of current which is input to the linear motor from the (equation 1), if the linear motor output $P_o$ is maximum, the linear motor input $P_I$ is also maximum.

Therefore, if the frequency of the input current is adjusted such that the amplitude I of current which is input to the linear motor is made constant and the linear motor input (power source output) becomes maximum, the linear compressor can be driven efficiently.

Figure 6:
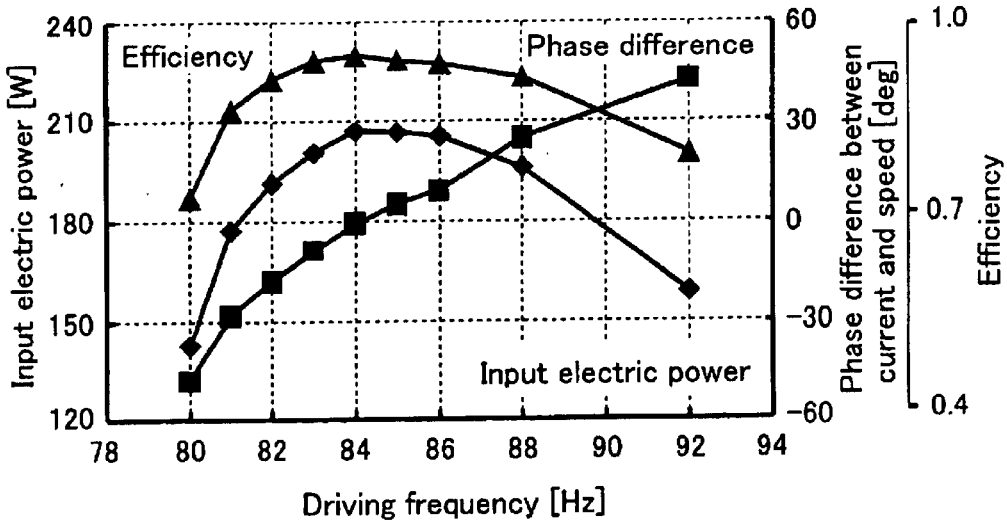
FIG. 6 is a graph showing a result of experiment of the embodiment.

FIG. 6 is a graph showing a result of experiment according to this embodiment. In this graph, the driving frequency is changed, and the input electric power, position difference of current and speed of the piston, and efficiency are measured under a condition that the current amplitude value is constant. As the efficiency, a certain value is defined as a reference value, and its absolute value is employed.

It can be found from FIG. 6 that the linear compressor can be driven with optimal efficiency by changing the driving frequency such that the input electric power becomes maximum under the condition that the amplitude value of current which is input to the linear compressor is made constant. It can also be found that when the linear compressor is driven with the optimal efficiency, since phase of speed of the piston and phase of current are the same, the linear compressor is in the resonance state.

Figure 7:
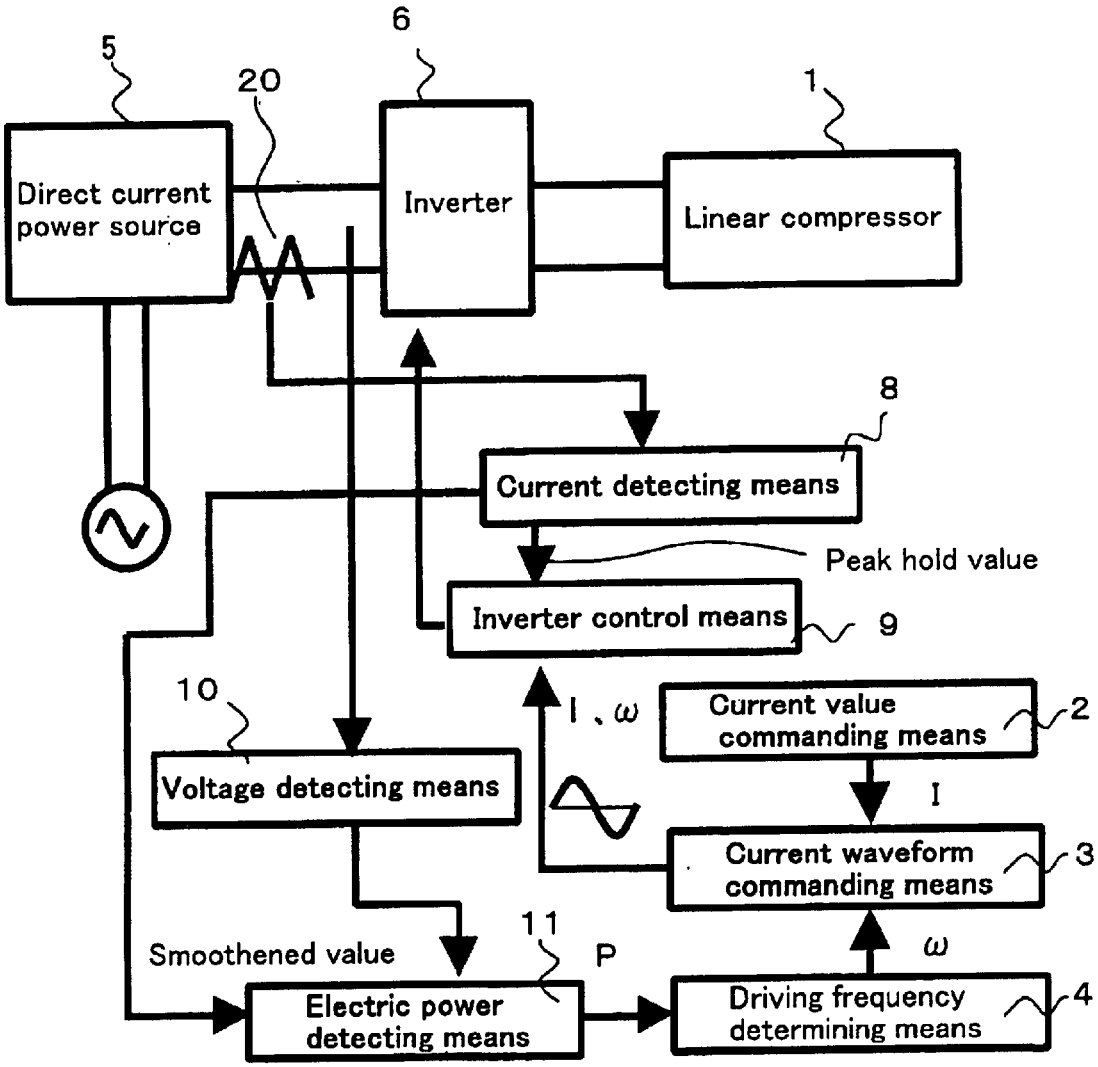
FIG. 7 is a block diagram showing a structure of a driving apparatus of a linear compressor according to another embodiment of the invention.

FIG. 7 is a block diagram showing a structure of a driving apparatus of a linear compressor 1 according to another embodiment of the present invention. This structure is different from that shown in FIG. 2 in that a position of the current sensor is on the side of input of the inverter 6, and the direct current voltage detecting means 10 detects direct current voltage. A detecting method of the output current which is output from the inverter and the electric power of the inverter using the current sensor 20 and the direct current voltage detecting means 10 will be explained with reference to FIGS. 7 and 8.

Figure 8:
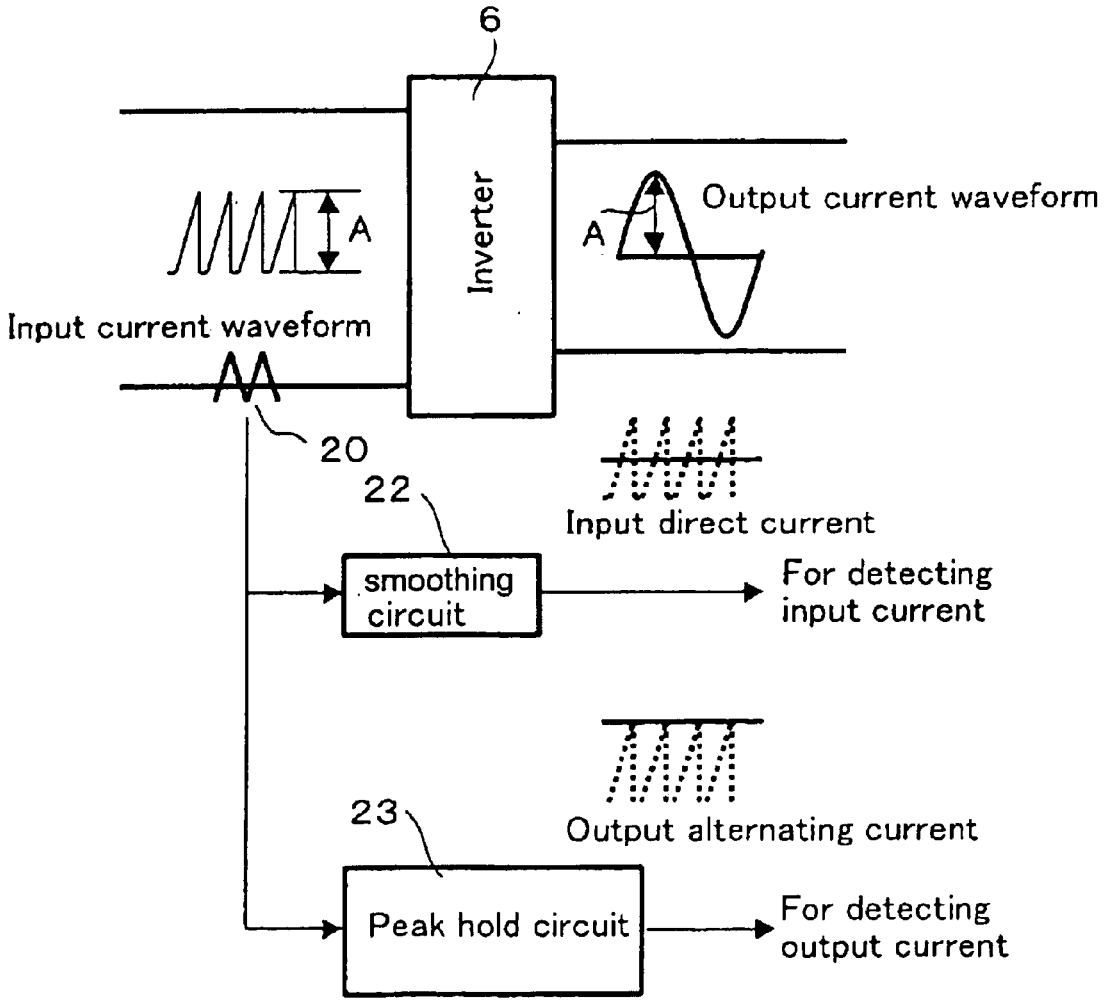
FIG. 8 is diagram of an essential portion of a current detecting circuit for explaining the embodiment.

Current flowing through the current sensor 20 in FIG. 7 is of sawtooth-like current waveform like the input current waveform shown in FIG. 8. This current is of waveform in which an instantaneous output current value of the inverter 6 is defined as a peak value, and ON and OFF are repeated in synchronization with PWM duty of the inverter 6. The current rises in a form triangle wave by time constant which is determined by inductance of a load motor, but since the circulating current of motor does not flow through this portion, the current falls instantaneously.

Therefore, a value (A in FIG. 8) obtained by peak-holding the input current waveform in FIG. 8 in a peak hold circuit 23 corresponds to an amplitude value of the inverter output current and thus, if this is detected, it is possible to detect and control the current value of the linear motor.

A value obtained by smoothing the input current waveform by a smoothing circuit 22 is a direct average current which is input to the inverter 6. If the smoothened value and the direct current voltage detected by the direct current voltage detecting means 10 are multiplied, the input electric power which is supplied to the inverter 6 can be calculated.

The inverter output electric power is a value obtained by multiplying the input electric power by conversion efficiency of the inverter 6, and since the conversion efficiency of the inverter portion is about 97% according to experiment, it can be found that the output electric power is equal to input electric power. If the conversion efficiency is largely varied by the input electric power value, the output electric power can precisely be detected by previously grasping the efficiency characteristics and incorporating the characteristics into control as a data table.

Therefore, the same effect can be obtained by detecting the inverter input electric power as described above and by controlling such that this becomes maximum, instead of detecting the inverter output electric power explained in FIG. 2.

This embodiment is characterized in that an overcurrent protective current sensor which is conventionally provided in an inverter circuit for an air conditioner can be commonly used.

Figure 9:
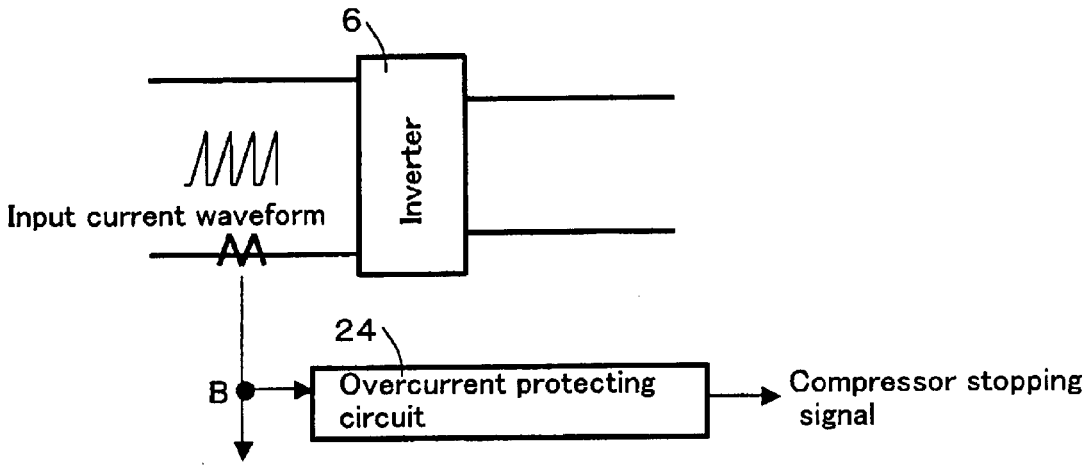
FIG. 9 is a block diagram of overcurrent protecting means in a general inverter circuit.

FIG. 9 is a block diagram of the overcurrent protecting means in a general inverter circuit. Input current which is supplied to the inverter 6 is detected, and when the peak value exceeds a permissible value by a comparison circuit, an overcurrent protecting circuit 24 outputs a compressor stopping signal. If a signal is taken out from a B point in FIG. 9, and this is connected to the smoothing circuit 22 or the peak hold circuit 23 in FIG. 8, it is unnecessary to newly add the current sensor.

Figure 10:
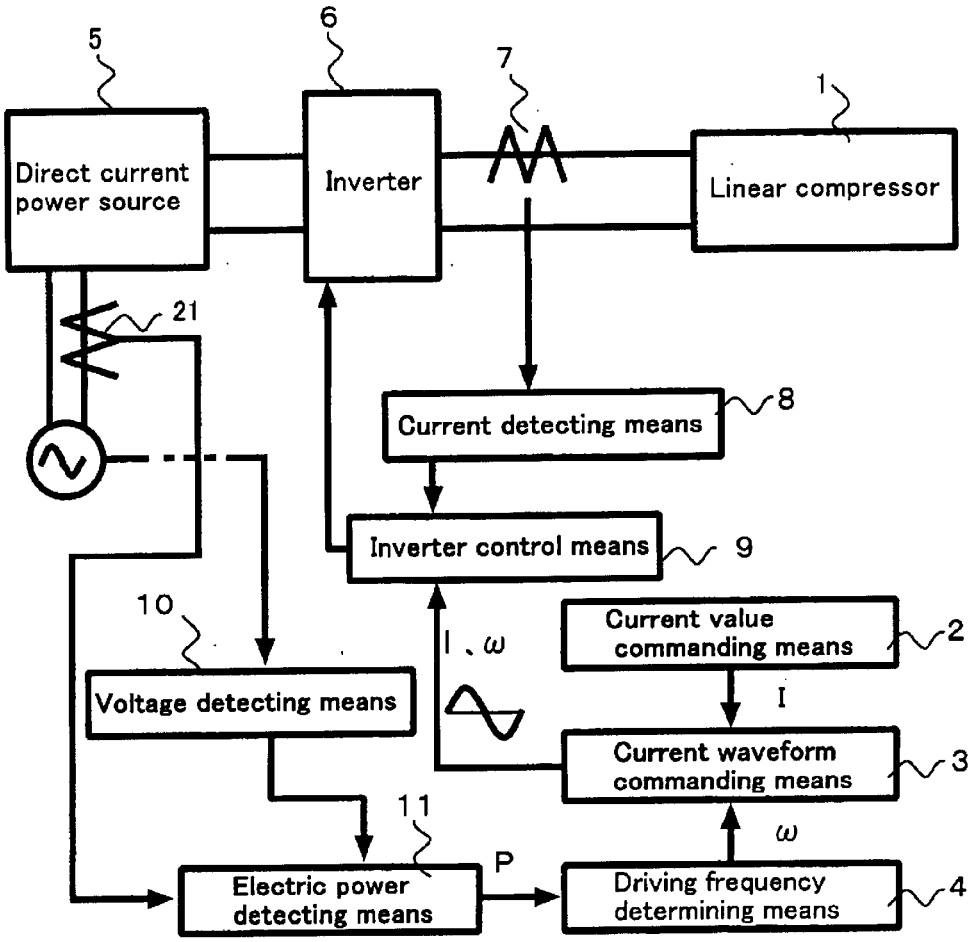
FIG. 10 is a block diagram showing a structure of a driving apparatus of a linear compressor according to another embodiment of the invention.

FIG. 10 is a block diagram showing a structure of a driving apparatus of a linear compressor 1 according to another embodiment of the present invention. This structure is different from that shown in FIG. 2 in that the electric power is detected from input current and input voltage to the direct current power source 5.

The input electric power (power source electric power, hereinafter) to the direct current power source 5 is detected as values obtained by multiplying power factor and effective value of current detected by a current sensor 21 shown in FIG. 10 and effective value of voltage detected by the voltage detecting means. When variation of the power factor is small, it may be a constant value. A value obtained by multiplying the power source electric power detected in this manner, and efficiency of the direct current power source 5 and efficiency of the inverter 6 becomes an inverter output electric power. Here, the efficiency of the direct current power source 5 is only a rectify diode bridge and a smoothened capacitor as described above and thus, this efficiency is extremely high as high as about 97% according to experiment and the inverter efficiency is also about 97% as described above. Therefore, it can be found that total is more than 90% and the efficiency is substantially equal the inverter output electric power.

Here, when each the conversion efficiency is largely varied by the input electric power value, it is possible to precisely detect the output electric power by previously grasping the efficiency characteristics and incorporating the characteristics as a data table. When a load (e.g., fan motor or the like) other than the linear compressor 1 is connected as a load of the direct current power source, if the load electric power is previously grasped and it is incorporated into control as a data table, or the fan motor is controlled by the same microcomputer as that of the driving apparatus, it is possible to grape the speed of the fan motor by itself, and the electric power can be subtracted.

In this manner, the same effect can be obtained also by detecting the power source electric power as described above and being controlled such that this power source electric power becomes maximum instead of detecting the inverter output electric power explained in FIG. 2.

The method for detecting the power source electric power according to this embodiment is characterized in that a current sensor for detecting power source current which is conventionally provided in an inverter circuit for an air conditioner can be commonly used.

Figure 11:
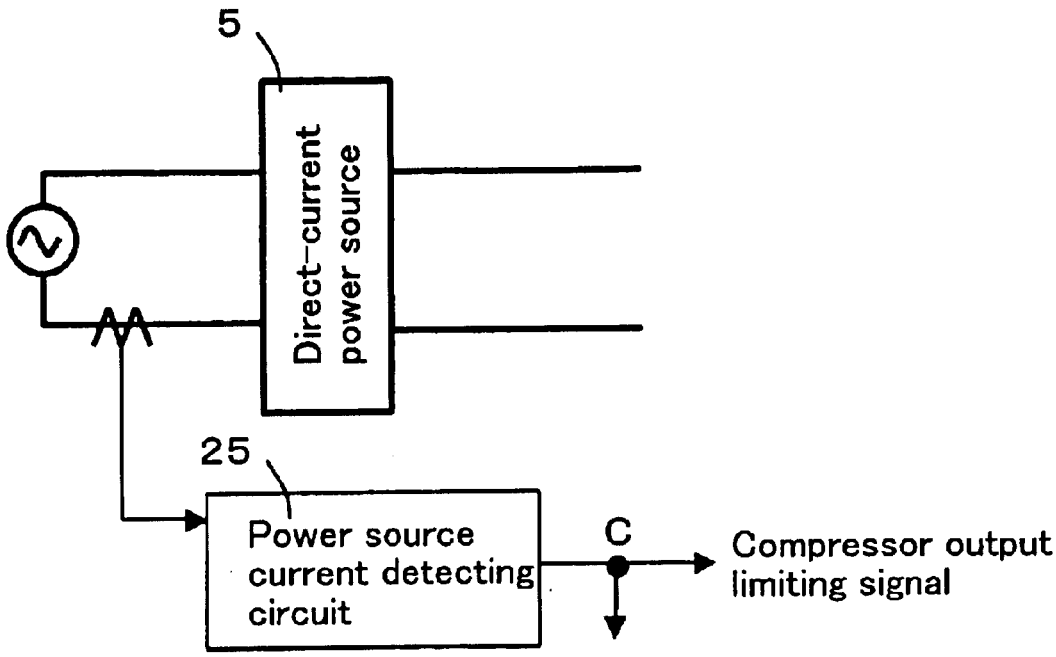
FIG. 11 is a block diagram for detecting power source current in the general inverter circuit.

FIG. 11 is a block diagram for detecting power source current in a general inverter circuit. Input current which is supplied to the direct current power source is detected, a power source current detecting circuit 25 converts the input current into analog direct current voltage or the like, and when the analog voltage exceeds a permissible value, the output of the compressor is limited. If a signal is taken out from a C point in FIG. 11, a conventional current sensor or power source current detecting circuit can be commonly used, and it is unnecessary to newly add the current sensor.

Figure 12:
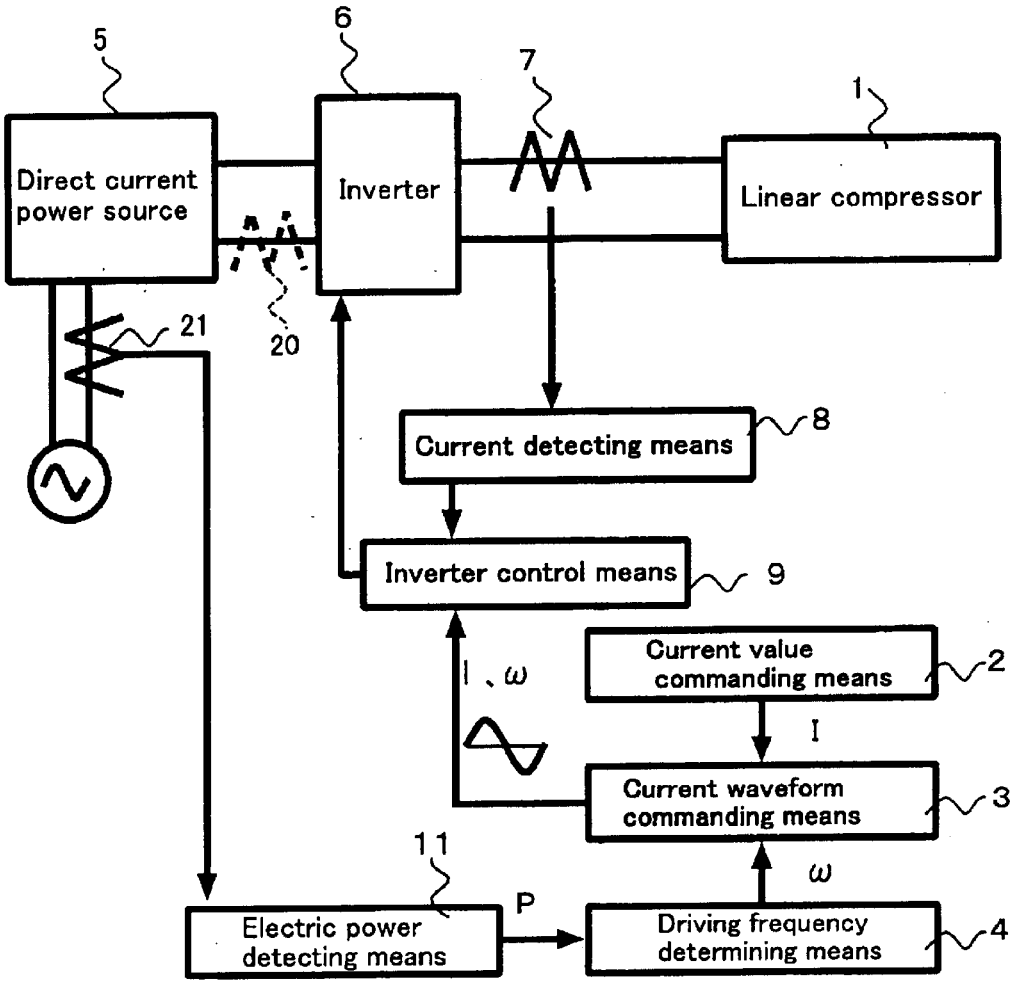
FIG. 12 is a block diagram showing a structure of a driving apparatus of a linear compressor according to another embodiment of the invention.
Figure 13:
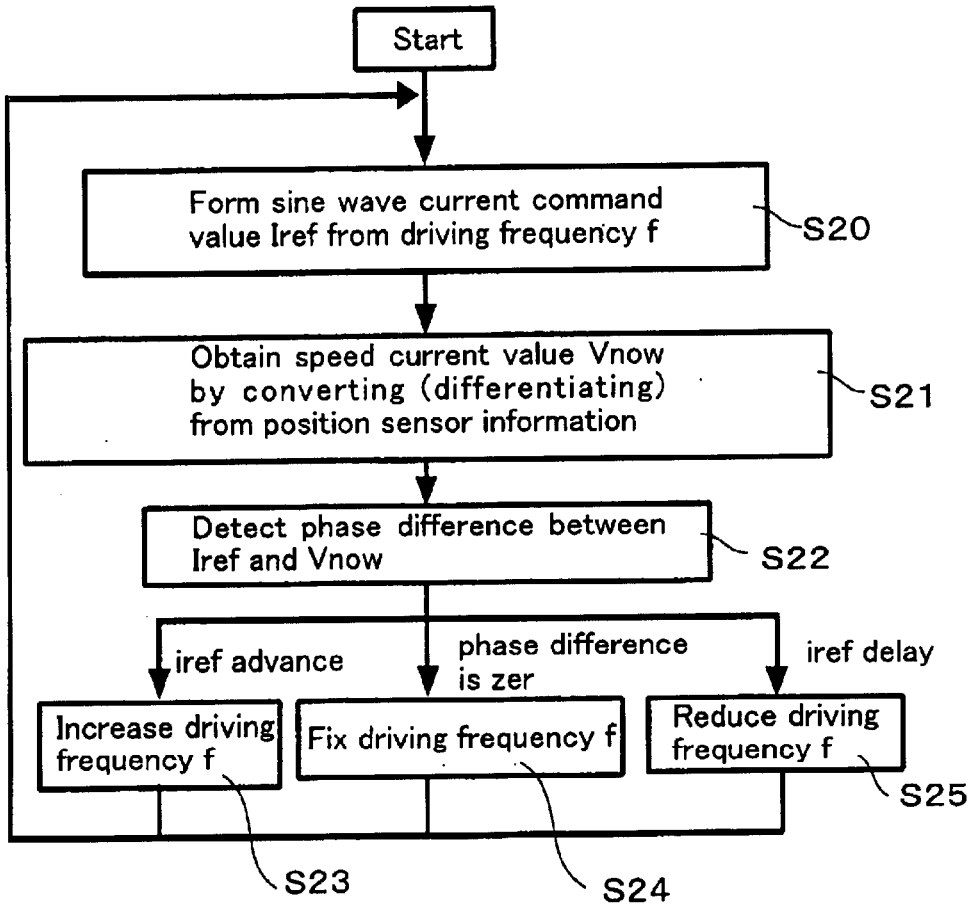
FIG. 13 is a flowchart showing a conventional resonance following operation having a position sensor.

FIG. 12 shows a driving apparatus according to another embodiment of the invention.

FIG. 12 is a block diagram showing a structure of the driving apparatus of the linear compressor 1 of the embodiment. In this embodiment, since the voltage of a commercial power source is constant and stable, the voltage detecting means is not used and the electric power is approximately detected only by power source current. According to this structure, although detection precision of electric power is slightly deteriorated, low cost which is required by recent customers can be realized.

In FIG. 12, a current sensor 20 for detecting the output current is disposed on the side of input of the inverter 6, and the current detecting means 8 shown in FIG. 7 is used. With this structure, existing current sensor can be commonly used as all current sensors (current sensor for detecting electric power and current sensor for detecting output current), and it is unnecessary to newly add a current sensor. If the current sensor 20 is disposed on the side of input of the inverter 6, the cost can be reduced to the utmost.

Industrial Applicability

As described above, the driving apparatus of a linear compressor has the following effect.

According to the present invention, an alternating current value which is supplied to the linear compressor is made substantially constant, and frequency of the input current is varied such that the electric power to be supplied becomes maximum. With this, it is possible to follow the variation in resonance frequency caused by variation in a load and as a result, the linear compressor can be actuated efficiently. According to this control method, a position sensor which detects a position of the piston is unnecessary and thus, the size of the entire driving apparatus of the linear compressor can be reduced, and cost thereof can be reduced.

Further, according to this invention, it is possible to approximately detect the input electric power which is supplied to the linear motor with a relatively simple calculation in which direct current voltage and direct current are multiplied. Therefore, relatively inexpensive microcomputer and MPU (micro processing unit) having slow processing speed can be used, and costs required for controlling the detection of electric power can be reduced.

Further, according to the invention, it is possible to detect the input current and output current to the inverter by detecting current of only one location using a shunt resistor and a current sensor which are previously provided as protecting circuits. Therefore, it is unnecessary to add a current sensor at all, and both the electric power detecting circuit and current control circuit can be reduced in size and cost.

Further, according to the invention, it is possible to approximately detect the input electric power to the linear motor with a relatively simple calculation in which voltage and current of a commercial power source are multiplied. Therefore, relatively inexpensive microcomputer and MPU (micro processing unit) having slow processing speed can be used, and costs required for controlling the detection of electric power can be reduced. Further, according to the invention, a current sensor for detecting power source current and a current sensor for detecting electric power which are conventionally provided in an air conditioner inverter circuit can commonly be used. Therefore, the electric power detecting circuit can be reduced in size and cost.

Further, according to the invention, the electric power is detected by the simplest method in which the input electric power which is supplied to the linear motor is approximately detected only by current which is input to the direct current power source. Therefore, relatively inexpensive microcomputer and MPU (micro processing unit) having slow processing speed can be used, and costs required for controlling the detection of electric power can be reduced. Further, according to the invention, a current sensor for detecting power source current and a current sensor for detecting electric power which are conventionally provided in an air conditioner inverter circuit can commonly be used. Therefore, the electric power detecting circuit can be reduced in size and cost.

Further, according to the invention, the output current which is output from the inverter is detected from current which is input to the inverter. Therefore, it is possible to detect the alternating output current using a shunt resistor or a current sensor which are previously provided as protecting circuits, and the current control circuit can be reduced in size and cost.

What is claimed is:

1. A driving apparatus of a linear compressor for driving a piston in a cylinder by a linear motor to generate compressed gas, comprising an inverter for outputting alternating current which is supplied to said linear motor, a direct current power source for supplying direct current voltage to said inverter, current value commanding means for determining and commanding magnitude of said alternating current, electric power detecting means for detecting input electric power which is supplied to said linear compressor, driving frequency determining means for varying driving frequency of said inverter such that the electric power detected by said electric power detecting means becomes maximum, current waveform commanding means for generating command current waveform from a command current value from said current value commanding means and from a driving frequency determined by said driving frequency determining means, inverter control means for sending a control signal to said inverter based on the command current waveform from said current waveform commanding means, current detecting means for detecting a smoothened value of saw tooth-like inverter input current as input current or detecting a peak value as output current, and voltage detecting means for detecting input voltage of said inverter, wherein said electric power detecting means calculates input electric power which is supplied to said linear compressor from current detected by said current detecting means and voltage detected by said voltage detecting means, said inverter control means sends a control signal to said inverter such that a deviation between a command current value from said current value commanding means and a detection current value from said current detecting means is reduced.

2. A driving apparatus of a linear compressor for driving a piston in a cylinder by a linear motor to generate compressed gas, comprising an inverter for outputting alternating current which is supplied to said linear motor, a direct current power source for supplying direct current voltage to said inverter, current value commanding means for determining and commanding magnitude of said alternating current, electric power detecting means for detecting input electric power which is supplied to said linear compressor, driving frequency determining means for varying driving frequency of said inverter such that the electric power detected by said electric power detecting means becomes maximum, current waveform commanding means for generating command current waveform from a command current value from said current value commanding means and from a driving frequency determined by said driving frequency determining means, inverter control means for sending a control signal to said inverter based on the command current waveform from said current waveform commanding means, current detecting means for detecting input current which is supplied to said direct current power source or output current which is output from said inverter, and voltage detecting means for detecting input voltage which is supplied to said direct current power source, wherein said electric power detecting means calculates input electric power which is supplied to said linear compressor from current detected by said current detecting means and voltage detected by said voltage detecting means, said inverter control means sends a control signal to said inverter such that a deviation between a command current value from said current value commanding means and a detection current value from said current detecting means is reduced.

3. A driving apparatus of a linear compressor for driving a piston in a cylinder by a linear motor to generate compressed gas, comprising an inverter for outputting alternating current which is supplied to said linear motor, a direct current power source for supplying direct current voltage to said inverter, current value commanding means for determining and commanding magnitude of said alternating current, electric power detecting means for detecting input electric power which is supplied to said linear compressor, driving frequency determining means for varying driving frequency of said inverter such that the electric power detected by said electric power detecting means becomes maximum, current waveform commanding means for generating command current waveform from a command current value from said current value commanding means and from a driving frequency determined by said driving frequency determining means, inverter control means for sending a control signal to said inverter based on the command current waveform from said current waveform commanding means, first current detecting means for detecting input current which is supplied to said direct current power source, and second current detecting means for detecting output current which is output from said inverter, wherein said electric power detecting means calculates input electric power which is supplied to said linear compressor from current detected by said first current detecting means and said direct current power source voltage, said inverter control means sends a control signal to said inverter such that a deviation between a command current value from said current value commanding means and a detection current value from said second current detecting means is reduced.

4. A driving apparatus of a linear compressor according to claim 3, wherein said second current detecting means detects a peak value of sawtooth-like inverter input current as inverter output current.

* * * * *